US011542814B2

(12) United States Patent
Macpherson et al.

(10) Patent No.: US 11,542,814 B2
(45) Date of Patent: Jan. 3, 2023

(54) TELEMETRY SYSTEM COMBINING TWO TELEMETRY METHODS

(71) Applicant: Baker Hughes Oilfield Operations LLC, Houston, TX (US)

(72) Inventors: John Macpherson, Celle (DE); Andrew Hawthorn, Missouri City, TX (US); Lei Fang, Houston, TX (US); John-Peter Van Zelm, Calgary (CA); Volker Peters, Wienhausen (DE); Andreas Peter, Celle (DE)

(73) Assignee: Baker Hughes Oilfield Operations LLC

( * ) Notice: Subject to any disclaimer, the term of this patent is extended or adjusted under 35 U.S.C. 154(b) by 0 days.

(21) Appl. No.: 17/104,747

(22) Filed: Nov. 25, 2020

(65) Prior Publication Data

US 2021/0156246 A1 May 27, 2021

Related U.S. Application Data

(63) Continuation of application No. PCT/US2020/061836, filed on Nov. 23, 2020.

(Continued)

(51) Int. Cl.

| | |
|---|---|
| ***E21B 47/16*** | (2006.01) |
| ***E21B 47/18*** | (2012.01) |
| ***E21B 47/125*** | (2012.01) |

(52) U.S. Cl.

CPC ..... *E21B 47/16* (2013.01); *E21B 47/125* (2020.05); *E21B 47/18* (2013.01)

(58) Field of Classification Search

CPC ..... E21B 47/12; E21B 47/125; E21B 47/13; E21B 47/14; E21B 47/16; E21B 47/18; E21B 47/20; E21B 47/22; E21B 47/24

See application file for complete search history.

(56) References Cited

U.S. PATENT DOCUMENTS 4,584,675 A * 4/1986 Peppers ..... E21B 47/18 340/853.7

6,909,667 B2 * 6/2005 Shah ..... E21B 47/18 367/83

(Continued)

FOREIGN PATENT DOCUMENTS

| | | | |
|---|---|---|---|
| WO | 2004113677 | A1 | 12/2004 |
| WO | 2019133366 | A1 | 7/2019 |
| WO | 2019199828 | A1 | 10/2019 |

OTHER PUBLICATIONS

International Search Report and Written Opinion of counterpart International Application serial No. PCT/US2020/061836, prepared by the Korean International Search Authority, dated Mar. 15, 2021, 11 pages.

*Primary Examiner* — Franklin D Balseca

(74) *Attorney, Agent, or Firm* — Jonathan Pierce; Pierre Campanac; Porter Hedges LLP

(57) ABSTRACT

A combined telemetry system that can be used while drilling a wellbore consists of a multi-hop telemetry method and a single-hop telemetry method combined in parallel. The multi-hop and single-hop methods can be operated in parallel, for example, so that each telemetry method caries data concurrently from the Measuring-While-Drilling tool located in the Bottom-Hole-Assembly. The multi-hop and single-hop methods can also be operated in series, for example, so that data from the Measuring-While-Drilling tool located in the Bottom-Hole-Assembly are first carried with the single-hop telemetry method and then transferred to the multi-hop telemetry method at one or more node(s) close to the surface. Preferably, the multi-hop telemetry method can also carry data from along-string sensors. Another combined telemetry system that can be used while drilling a wellbore consists of two single-hop telemetry methods combined in parallel.

19 Claims, 2 Drawing Sheets

Related U.S. Application Data

(60) Provisional application No. 62/941,387, filed on Nov. 27, 2019.

(56) References Cited

U.S. PATENT DOCUMENTS

| | | | | |
|---|---|---|---|---|
| 8,115,651 | B2 * | 2/2012 | Camwell | E21B 47/12 340/853.2 |
| 9,879,525 | B2 * | 1/2018 | Morrow | E21B 47/007 |
| 10,961,843 | B2 * | 3/2021 | Logan | G01S 5/02 |
| 2003/0151977 | A1 | 8/2003 | Shah et al. | |
| 2005/0087368 | A1 | 4/2005 | Boyle et al. | |
| 2011/0205847 | A1 | 8/2011 | Lemenager | |
| 2012/0286967 | A1 | 11/2012 | Alteirac et al. | |
| 2015/0077265 | A1 * | 3/2015 | Gao | E21B 47/16 340/853.7 |
| 2015/0159482 | A1 | 6/2015 | Xu | |
| 2016/0215612 | A1 | 7/2016 | Morrow | |
| 2018/0223652 | A1 | 8/2018 | Roberson | |
| 2019/0112915 | A1 | 4/2019 | Disko et al. | |

* cited by examiner

TELEMETRY SYSTEM COMBINING TWO TELEMETRY METHODS

CROSS-REFERENCE TO RELATED APPLICATIONS

This application claims the benefit of priority to U.S. application Ser. No. 62/941,387, filed on Nov. 27, 2019, which is incorporated herein by reference for all purposes.

This application claims the benefit of priority to Int. application serial no. PCT/US20/61836, filed on Nov. 23, 2020, which is incorporated herein by reference for all purposes.

BACKGROUND

This disclosure relates generally to apparatus and methods for carrying information along a pipe string in a wellbore. This disclosure relates more particularly to telemetries that are combined on a pipe string, and the use thereof in a wellbore.

There are essentially two physical topologies addressing the carrying of information along a pipe string in a wellbore, multi-hop and single-hop. All methods of carrying data from downhole to the surface (and from the surface to downhole) are affected by signal attenuation. At some distance from its source, the signal power drops below some limit that defines reliable detection. Before it approaches this limit, it must be detected and either boosted or repeated up the pipe string. Boosting means the information-bearing signal is simply re-amplified, while repeating means that the information in the signal is read, corrected, and then rebroadcast onwards to the surface. So any transmission technology may use multi-hop or single-hop topology, depending on the distance of transmission.

The multi-hop topology involves telemetry methods that utilize multiple signal repeaters or signal boosters (also called nodes) along the pipe string to carry data from a Measuring-While-Drilling ("MWD") tool in the Bottom Hole Assembly ("BHA") to the surface. The BHA is located at the distal end of the pipe string, and the lowermost portion of the BHA is the drill bit, which is used to create the wellbore by breaking the rock of the formation. Examples of such telemetry methods include acoustic telemetry in the pipe wall, and telemetry along a wire in the pipe bore (called wired pipe) which uses couplers across tool joints. A reason for utilizing multiple nodes is that the distance between transmitters and receivers is limited due to the attenuation of the telemetry signal in these telemetry methods. One advantage of the multi-hop topology may be that each node can contain sensors that can be used to provide along-string-measurements ("ASM"). These sensors may measure properties related to the wellbore or the formation.

The transmission rate between nodes in a multi-hop topology can be far greater than the transmission rate in a single-hop topology, but the effective rate in a multi-hop topology, that is, the transmission rate achieved between end nodes, may be similar to the transmission rate in a single-hop topology. This difference between inter-node transmission rate and effective transmission rate is usually due to an error correction overhead, and the time-lapse necessary to receive, correct, and send data sequences in each intermediary node. For example, the inter-node transmission rate may be 120 bits-per-second (bps) or higher, and the effective transmission rate may be 3-10 bps.

The single-hop topology involves telemetry methods that have low attenuation between transmitter and receiver, and hence, can achieve long transmitter-receiver distances. These telemetry methods can therefore carry data from a Measuring-While-Drilling ("MWD") tool in the Bottom Hole Assembly ("BHA") to the surface. Examples of such telemetry methods include mud-pulse telemetry ("MPT") in the pipe bore, and Electro-Magnetic ("EM") telemetry in the formation surrounding the wellbore.

The rate at which the transmission signal that is encoding the data is generated may be slower in a single-hop topology than the inter-node transmission rate in a multi-hop topology. For example, the mud pulser in an MPT single-hop method generates the signal conveying the data, and may only be capable of 40 bps. In practice, however, signal reflections at the surface or other phenomena can significantly affect the reliability of the data transmission, and this transmission rate may drop to about 15 to 20 bps for reliable transmission. For example, in the case of MPT, these reflections are primarily caused by surface equipment located proximal to the surface node, such as fluid hoses, valves and abrupt changes in the diameter of the pipe bore. Furthermore, in the case of MPT, the surface mud pumps, which are used when drilling or fracturing, can also constitute a significant noise source that impairs reliable transmission.

Thus, there is a continuing need in the art for apparatus and methods for carrying information along a pipe string in a wellbore at the maximum rate possible by the device generating the telemetry signal.

BRIEF SUMMARY OF THE DISCLOSURE

The disclosure describes a telemetry system for carrying information along a pipe string in a wellbore, for example, while drilling the wellbore.

In some embodiments, the telemetry system combines a first telemetry method implemented in a multi-hop topology, and a second telemetry method implemented in a single-hop topology. The multi-hop topology includes at least three, and preferably more than three, nodes. The single-hop topology includes only two nodes. Each telemetry topology has a surface node, which interfaces with a surface computer system. The other nodes of the multi-hop topology, which are also called the downhole nodes of the multi-hop topology, are preferably proximal to the surface. For example, the other nodes of the multi-hop topology may be located in a vertical portion of the wellbore under the drilling derrick. The other node of the single-hop topology, which is also called the downhole node of the single-hop topology, is preferably distal from the surface, for example, more distant from the surface than all the nodes of the multi-hop topology. For example, the other node of the single-hop topology may be provided as part of an MWD tool located in a BHA.

In other embodiments, the telemetry system combines a first telemetry method implemented in a single-hop topology, and a second telemetry method also implemented in a single-hop topology. The single-hop topology includes only two nodes. Each telemetry topology has a surface node, which interfaces with a surface computer system. The downhole node of the first telemetry method is preferably proximal to the surface. For example, the downhole node of the first telemetry method may be located in a vertical portion of the wellbore under the drilling derrick. The downhole node of the second telemetry method is preferably distal from the surface, for example, more distant from the surface than the downhole node of the first telemetry. For example, the downhole node of the second telemetry may be provided as part of an MWD tool located in a BHA.

For signal transmission, the first telemetry method can utilize a different physical channel than the second telemetry method. For example, the first telemetry method is preferably an acoustic telemetry in the pipe wall, but it may alternatively be a wired pipe or another known telemetry method that can be implemented in a multi-hop topology. The second telemetry method is preferably an MPT in the pipe bore, but it may alternatively be an EM telemetry in the media surrounding the pipe string or another known telemetry method that can be implemented in single-hop topology.

Sensors are coupled to the downhole nodes of the first telemetry method. These sensors can act as receivers for signals transmitted through the physical channel of the second telemetry method. For example, the sensors are preferably pressure sensors configured to measure pulses in the mud inside the pipe bore, but they can alternatively be EM sensors configured to measure electromagnetic waves in the media surrounding the pipe string. The signals received by the sensors are decoded to recover the data, the data are communicated to the nodes and can be retransmitted across the nodes of the first telemetry method. Accordingly, the first and second telemetry methods may be used in series or in parallel. Thus, in use, data may be broadcasted by the downhole node of the second telemetry method, and received by the surface node of the second telemetry method, as well as by the sensors coupled to the downhole nodes of the first telemetry method. Then, the downhole nodes of the first telemetry method may retransmit the data to the surface node of the first telemetry method. The surface computer system, which interfaces with the surface node of the first telemetry method and the surface node of the second telemetry method, can collect several, independent receptions of the data that were broadcasted by the downhole node of the second telemetry method. These several, independent receptions of the data can be analyzed with signal processing techniques, so that the data can be reliably determined, even in the presence of noise(s) or other parasitic signal(s) in the independent receptions of the data.

By combining the first telemetry method, and the second telemetry method, the telemetry system may reliably provide a higher transmission rate in various drilling operations, including Conventional Drilling, Managed Pressure Drilling ("MPD") and Dual Gradient Drilling ("DGD"). The telemetry system can also provide reliable decoding of the transmission signal generated by the second telemetry method, and telemetry bandwidth while tripping the pipe string, and potentially during connection or removal of pipes to the pipe string.

Data transmission may be bi-directional in either topology, but preferably, a common downlink signal is transmitted through the physical channel of the second telemetry method, and received by the sensors coupled to the nodes of the first telemetry method, and by the distal node of the second telemetry method.

The disclosure also describes a method for transmitting information along a pipe string in a wellbore, for example, while drilling the wellbore, using the telemetry system described hereinabove.

The method may include the step of analyzing the quality of signals transmitted through the physical channel of the second telemetry method. The quality of the signals may include average or peak magnitude of the signals, a ratio of the average or peak magnitude of the signals to the average or peak magnitude of noise. The method may include the step of transmitting the quality of the signals transmitted through the physical channel of the second telemetry method to a surface computer system, and selecting a sensor coupled to a node of the first telemetry method for receiving BHA data. The selection may be based on achieving the highest bandwidth for the telemetry system.

BRIEF DESCRIPTION OF THE DRAWINGS

For a more detailed description of the embodiments of the disclosure, reference will now be made to the accompanying drawings, wherein.

DETAILED DESCRIPTION

Figure 1:
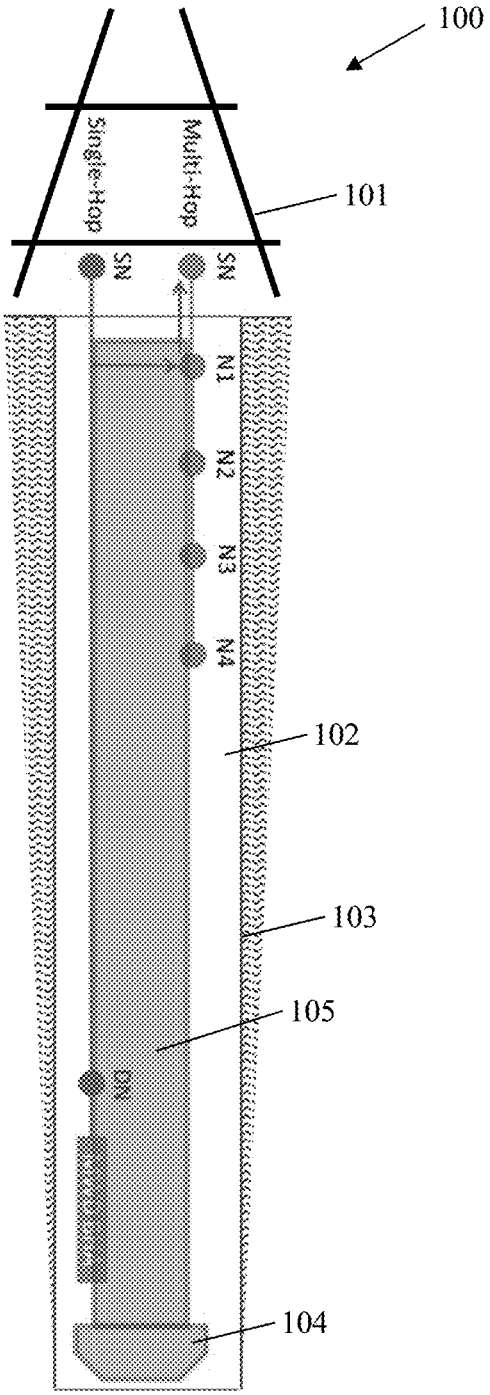
FIG. 1 is a schematic view of a telemetry system that is particularly suitable for uplink and that combines a first telemetry method implemented in a multi-hop topology, and a second telemetry method implemented in a single-hop topology.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A combined telemetry system that can be used while drilling a wellbore consists of a telemetry method deployed in a single-hop topology and a telemetry method deployed in a multi-hop topology. The multi-hop topology contains nodes spaced along the drill string that either re-generate or boost a telemetry signal. The multi-hop nodes further contain along-string sensors. The multi-hop telemetry method can carry data from the along-string sensors. The along-string sensors are also capable of receiving a telemetry signal of the single-hop telemetry method. The single-hop and multi-hop methods can be operated in parallel, for example, so that each telemetry method carries data concurrently from the MWD tool located in the BHA. The single-hop telemetry method can carry only data from the MWD tool located in the BHA, while the multi-hop telemetry method can also carry only data from the along-string sensors. The single-hop and multi-hop methods can also be operated in series, for example, so that data from the MWD tool located in the BHA are first carried with the single-hop telemetry method and then transferred to the multi-hop telemetry method at a node close to the surface. The multi-hop topology can consist of as few as two downhole telemetry nodes containing along-string sensors, but usually, it includes more proximal, downhole telemetry nodes containing along-string sensors. The individual node-to-node telemetry rate of the multi-hop method is greater than or equal to the telemetry rate of the single-hop method.

Initially, the multi-hop topology can consist of only two nodes, one on the surface and one downhole. As drilling progresses, more nodes can be added to the pipe string when the signal attenuation between the downhole node and the surface becomes excessive for reliable detection of the signal. Then the multi-hop topology consists of three or more nodes.

The sensors that are coupled to the downhole nodes (especially the first downhole node in some embodiments) of the multi-hop method can provide receivers for the signals transmitted through the physical channel of the single-hop telemetry method. These sensors may be located further away from surface equipment, which may be a source of signal reflections and noise, than the surface node of the single-hop topology.

Furthermore, the inter-node transmission rate between the surface node and the downhole nodes of the multi-hop method is higher than the effective transmission rate from end-node to end-node. Thus, the downhole nodes (especially the first downhole node in some embodiments) of the multi-hop method can retransmit the data received from the single-hop telemetry method.

The data transmission rate of the single-hop telemetry method can be increased to the maximum capabilities of the transmitter (for example, 40 bps and to even 80 bps or even higher with a mud-pulser), even in the presence of signal reflections and noise at the surface.

There may even still be sufficient bandwidth available through the multi-hop telemetry method to transmit ASM data during drilling, which may be used to monitor hole cleaning, etc.

Downlink telemetry information consisting of commands or data may use either or both of the single-hop and multi-hop telemetry topologies and their respective telemetry methods.

Alternatively, the combined telemetry system can be used in a parallel mode, wherein the multi-hop telemetry method transmits data from the downhole node and in communication with the MWD tool of the BHA, and wherein the single-hop telemetry method transmits ASM data from intermediate sections of the pipe string.

FIG. 1 is a schematic diagram of an exemplary drilling system 100 that may employ the principles of the present disclosure, according to one or more embodiments. The drilling system 100 includes a derrick 101 positioned at the surface, and a wellbore 102 that extends from the surface into a subterranean formation 103. The drilling system 100 may further include a drill bit 104 coupled to a drill string 105. As the drill bit 104 rotates, it creates the wellbore 102, which penetrates the subterranean formation 103. The drilling system 100 may further include a bottom hole assembly (BHA) coupled to the drill string 105 near the drill bit 104. The BHA may comprise various downhole measurement tools such as, but not limited to, measurement-while-drilling (MWD) tools, which may be configured to take downhole measurements of drilling conditions. FIG. 1 further illustrates a combined telemetry system that comprises a first telemetry method implemented in a multi-hop topology, which is shown on the right of a drill string and includes surface nodes SN and proximal downhole nodes N1, N2, N3, and N4. The first telemetry method may be provided with acoustic telemetry in the pipe wall. The first telemetry method is combined with a second telemetry method implemented in a single-hop topology, which is shown on the left of the drill string and includes surface nodes SN and a distal downhole node DN that is disposed in an MWD tool that is part of a BHA. The second telemetry method may be provided with MPT.

Each telemetry method uses a different physical channel. Each topology has a surface node, which interfaces to a surface computer system. The surface computer system can include separate computers for each telemetry method, or preferably, there can be one surface computer for both telemetry methods. Data transmission can be bi-directional in either method.

Single-Hop Characteristics: The single-hop telemetry rate is typically slower than the inter-node multi-hop rate. For example, the current maximum operational single-hop rate for MPT is 40 bps, although the mud-pulser can operate at higher rates.

Multi-Hop Characteristics: The inter-node telemetry rate is typically far greater than the single-hop telemetry rate, but effective rates may be similar. This is due to higher attenuation in the multi-hop topology (hence requiring more nodes), a high error correction overhead, and time lags to receive, correct, and send each data sequence in each node. For example, the inter-node raw rate of acoustic telemetry in the pipe wall can be approximately 120 bps, and the effective network rate can be 3-10 bps, for example, 4-6 bps, 7-9 bps, 5 bps, or 8 bps. The inter-node rate between the surface node and the first downhole node (SN to N1) can possibly be higher than 120 bps when the attenuation in this section of the pipe string is low (for example in a vertical wellbore). Each node may contain sensors (along-string-measurements). These sensors can measure properties related to the wellbore or formation, examples of which are the pressure and temperature of the drilling fluid both in the pipe bore and in the annulus between the outside of the pipe and the borehole wall, torque or axial loads in the pipe string, hole size of the wellbore, resistivity of the formation, seismic waveforms traveling through the formation, dynamics measuring sensors, such as accelerometers, navigational sensors, such as magnetometers, inclinometers, gyroscopic sensors, measuring position. Furthermore, each node may contain sensors that can measure the telemetry stream in the single-hop telemetry method. The same sensors, for example, pressure sensors, can measure properties related to the wellbore or formation and the telemetry stream in the single-hop method. The multi-hop method, typically acoustic telemetry in the pipe wall, should have sufficient intra-node bandwidth to carry the data measured by the sensors to the surface. While each node of the multi-hop topology can act as a receiver for the single-hop telemetry method, this capability may be most important for the highest downhole node (N1) in this embodiment. Using downhole nodes as downhole receivers for the single-hop telemetry method—in other words operating the two multi-hop and the single-hop telemetry methods in parallel—has significant advantages explained below.

Data Rate: The single-hop telemetry method, typically MPT, may have a transmitter at the downhole node capable of a moderate data rate, such as 40 bps or higher. However, without the multi-hop telemetry method, the single-hop telemetry method would operate at a transmission of about 15 to 20 bps for reliable transmission because reflections and channel attenuation make these higher rates challenging. Indeed, reflections significantly affect the reliability of data transmission. These reflections are primarily from surface equipment, located proximal to the surface node, such as fluid hoses, valves, and abrupt changes in the internal diameter of the pipe. The surface mud pumps are also a significant noise source. By combining the single-hop topology with the multi-hop topology, the single-hop telemetry method, typically MPT, can operate at its maximum rate (40 bps or higher, for example 80 bps) since the effect of the noise sources can be diminished in the signals received by the sensors of the downhole nodes of the multi-hop topology, or with signal processing techniques applied to the several signals received at the surface. A raw rate of 40 bps can translate to a compressed rate of 240 bps, or higher, for standard MWD data.

ASM: The combined telemetry system can carry data from both the downhole tools in the BHA and from sensors in ASM located in nodes. These data can be important for MPD operations, and advanced applications (e.g., hole cleaning). "Fluid Property Applications," below, describes one possible application using a combination of the single-hop and multi-hop topologies.

Telemetry System Optimization: The measurement of the mud-pulse signal at multiple nodes of the multi-hop topology provides information for mud-pulse channel characterization. This characterization can be used for the optimization of the mud-pulse transmission (for example, frequency, amplitude, modulation) for increasing data rate and data reliability in the uplink, downlink, or both directions. The downhole receiving nodes can optionally generate quality information of the MPT signal, and the quality information can be sent to the surface for mapping attenuation characteristics of the MPT signal in real-time.

Telemetry System Self-adaption: The telemetry system can optionally be self-adaptive by finding the optimum downhole receiver for maximum bandwidth of the telemetry system. If, for example, the MPT rate is limited to 10 bps between DN and N1 but 40 bps between DN and N2, the telemetry system data rate is likely higher using N2 as the downhole receiver.

Fluid Property Applications: The single-hop telemetry method, such as MPT, may generate a pressure wave that travels towards the surface in the pipe bore. It may also generate another wave that travels downwards in the pipe, through the BHA and the drill bit, and then travels towards the surface in the annulus between the pipe string and borehole wall. This pressure wave can reveal properties of the fluid between multi-hop nodes, for example, properties related to fluid influxes or mud sweeps or cuttings load. As an example, gas in the fluid would decrease the signal coherence and increase signal attenuation, and would be detectable between nodes of the multi-hop telemetry method. The pressure wave would be measured by both pressure sensors in the pipe bore in the multi-hop nodes, and by annulus pressure sensors in the multi-hop nodes.

Data While Tripping: If batteries power the downhole single-hop node, and the single-hop mode does not need flowing fluid (a single-hop method such as EM), then pressure data or other MWD data is available continuously during tripping, so long as a multi-hop node is below the surface. This configuration can provide pressure data or other MWD data measured in the open hole section, which may often be the most critical. This configuration would also allow the use of EM single-hop technology in the offshore environment, by using a sensor of a multi-hop node as a receiver.

Data during a Connection of pipe or Surface Disconnect of pipe: if a viable acoustic path exists, then pressure data or other MWD data will be available when the pipe is added or removed from the pipe string (again with downhole battery power, and for a single-hop technology that does not use flowing fluid). This means that continuous telemetry may be provided in operations where the pipe string is disconnected on the surface from the top drive for any reason, so long as an acoustic path exists. The acoustic path could be, for example, through the rotary table since the pipe string is acoustically coupled to the rotary table via drilling slips when the top drive is disconnected.

Figure 2:
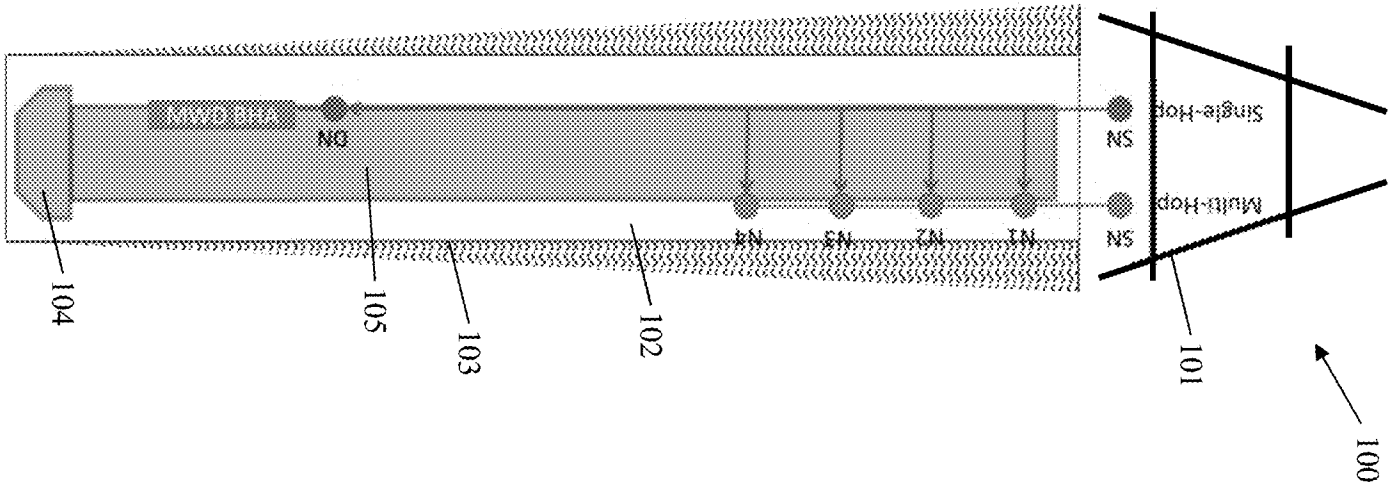
FIG. 2 is a schematic view of another telemetry system that is particularly suitable for downlink and that also combines a first telemetry method implemented in a multi-hop topology, and a second telemetry method implemented in a single-hop topology.

Common Downlink: Surface downlinking can send commands and data to both topologies. Each node in the multi-hop topology can have sensors capable of receiving telemetry signals generated by the single-hop telemetry method (for example, pressure sensors when the single-hop method is MPT) and processing capability. A common downlink signal is transmitted through the physical channel of the single-hop telemetry method, and received by the sensors coupled to the nodes of the multi-hop topology, and by the distal node of the single-hop topology. An example of surface downlinking is illustrated in FIG. 2, wherein the constituent parts of the exemplary drilling system shown are as defined for FIG. 1. In this example, the single-hop and multi-hop telemetries can be operated in parallel, so that each topology carries commands concurrently from the computer system located at the surface. The single-hop and multi-hop telemetries can also be operated in series, so that commands from the computer system located at the surface are first carried with the single-hop topology and then transferred to the multi-hop topology at a node distant from the surface. Again, the individual node-to-node telemetry rate of the multi-hop topology may be greater than or equal to the telemetry rate of the single-hop topology.

Reliability: If each topology has a surface node, then, in the event of unexpected noise (e.g., caused by top drive vibrations), unexpected attenuation (e.g., attenuation of a pipe acoustic signal caused by the closure of a Blow-Out-Preventer or a Rotary-Control-Device) or a failure in either topology, the telemetry system can continue to provide data although at a possibly lower data rate and with lower functionality. This parallel operational capability could reduce non-productive-time while drilling.

What is claimed is:

1. A telemetry system for carrying information along a pipe string in a wellbore, comprising:

a first telemetry method implemented in a multi-hop topology, wherein the multi-hop topology includes a first surface node and at least two proximal downhole nodes;

a second telemetry method implemented in a topology that includes at least a second surface node in communication with a distal downhole node; and sensors communicatively coupled to the at least two proximal downhole nodes of the multi-hop topology and capable of receiving signals transmitted with the second telemetry method, wherein each surface node interfaces with a surface computer system, wherein the first telemetry method has an inter-node transmission bandwidth higher than a transmission bandwidth of the second telemetry method, and wherein the telemetry system is configured to be self-adaptive by:

comparing telemetry bandwidths to the sensors using the second telemetry method, carrying the information from the distal downhole node with the second telemetry method, using one of the sensors having a highest telemetry bandwidth as a receiver for the second telemetry method, and transferring the information to the first telemetry method at one of at least two proximal downhole nodes, the one of at least two proximal downhole nodes being coupled to the one of the sensors having the highest telemetry bandwidth.

2. The telemetry system of claim 1, wherein the first telemetry method utilizes signal transmission in a different physical channel than the second telemetry method.

3. The telemetry system of claim 2, wherein the first telemetry method is an acoustic telemetry in a wall of the pipe string.

4. The telemetry system of claim 2, wherein the second telemetry method is a mud-pulse telemetry in a bore of the pipe string.

5. A method for carrying information along a pipe string in a wellbore, comprising:

performing a first telemetry method implemented in a multi-hop topology, wherein the multi-hop topology includes a first surface node and at least two proximal downhole nodes;

performing a second telemetry method implemented in a topology that includes a second surface node in communication with a distal downhole node;

communicatively coupling sensors to the at least two proximal downhole nodes of the multi-hop topology; and operating the first telemetry method with an inter-node transmission bandwidth higher than a transmission bandwidth of the second telemetry method;

wherein the sensors are capable of receiving signals transmitted with the second telemetry method, wherein the method further comprises comparing telemetry bandwidths to the sensors using the second telemetry method, and wherein each surface node interfaces with a surface computer system.

6. The method of claim 5, wherein the first telemetry method utilizes signal transmission in a different physical channel than the second telemetry method.

7. The method of claim 5 further comprising providing power to the distal downhole node with a battery.

8. The method of claim 7 wherein the second telemetry method is an electromagnetic telemetry in a formation surrounding the wellbore.

9. The method of claim 8 wherein the sensors are capable of receiving the signals transmitted with the second telemetry method while tripping the pipe string out of the wellbore.

10. The method of claim 8 wherein the first telemetry method is an acoustic telemetry in a wall of the pipe string.

11. The method of claim 10 wherein the sensors are capable of receiving the signals transmitted with the second telemetry method at the same time a pipe joint is added to the pipe string.

12. The method of claim 10 wherein the sensors are capable of receiving the signals transmitted with the second telemetry method at the same time a pipe joint is removed from the pipe string.

13. The method of claim 5, further comprising adding nodes to the multi-hop topology as drilling progresses.

14. The method of claim 5, further comprising:

analyzing the signals transmitted with the second telemetry method that are received by the sensors to generate attenuation characteristics of the second telemetry method; and transmitting the attenuation characteristics to the surface computer system with the first telemetry method.

15. The method of claim 5, further comprising using one of the sensors having a highest telemetry bandwidth as a receiver for the second telemetry method.

16. The method of claim 15, comprising carrying the information from the distal downhole node with the second telemetry method, and transferring the information to the first telemetry method at one of at least two proximal downhole nodes, the one of at least two proximal downhole nodes being coupled to the one of the sensors having the highest telemetry bandwidth.

17. The method of claim 16, wherein the first telemetry method utilizes signal transmission in a different physical channel than the second telemetry method.

18. The method of claim 17, wherein the first telemetry method is an acoustic telemetry in a wall of the pipe string.

19. The method of claim 18, wherein the second telemetry method is a mud-pulse telemetry in a bore of the pipe string.

* * * * *